US005414406A

United States Patent [19]

Baxter

[11] Patent Number: 5,414,406

[45] Date of Patent: May 9, 1995

[54] SELF-TUNING VEHICLE HORN

[75] Inventor: Melburn J. Baxter, Deland, Fla.

[73] Assignee: Sparton Corporation, Jackson, Mich.

[21] Appl. No.: 871,718

[22] Filed: Apr. 21, 1992

[51] Int. Cl.[6] ..... G08B 3/00

[52] U.S. Cl. ..... 340/388.1; 116/142 R; 340/384.1; 381/96

[58] Field of Search ..... 340/388, 384 E, 384 R, 340/404, 384.6, 384.1, 384.7, 384.73, 388.1, 404.1; 116/142 R; 381/96, 123, 156, 198; 331/172, 173, 154

[56] References Cited

U.S. PATENT DOCUMENTS

| | | | |
|---|---|---|---|
| 2,860,183 | 11/1958 | Conrad | 381/96 |
| 3,009,991 | 11/1961 | Bekey | 381/96 |
| 3,743,868 | 7/1973 | Kawada | 331/158 |
| 3,967,143 | 6/1976 | Watanabe et al. | 331/116 R |
| 4,001,817 | 1/1977 | Squires . | |
| 4,195,284 | 3/1980 | Hampshire et al. . | |
| 4,361,952 | 12/1982 | Neese | 116/142 R |
| 4,389,638 | 6/1983 | Gontowski, Jr. . | |
| 4,393,373 | 7/1983 | Torii et al. . | |
| 4,813,123 | 3/1989 | Wilson et al. | 29/593 |
| 5,049,853 | 9/1991 | Yoon | 340/388 |
| 5,109,212 | 4/1992 | Cortinovis et al. . | |
| 5,181,019 | 1/1993 | Gottlieb et al. . | |

FOREIGN PATENT DOCUMENTS

| | | | |
|---|---|---|---|
| 1428483 | 1/1966 | France . | |
| 3137747 | 3/1983 | Germany | 381/96 |
| 242696 | 2/1987 | Germany | 381/192 |
| 0156096 | 12/1981 | Japan | 381/96 |
| 396702 | 1/1974 | U.S.S.R. . | |

*Primary Examiner*—Brent Swarthout

*Attorney, Agent, or Firm*—Reising, Ethington, Barnard, Perry & Milton

[57] ABSTRACT

A vehicle horn is disclosed with an electronic switching circuit which operates at a switching frequency equal to the resonant frequency of the horn. A sweep frequency oscillator generates a switching pulse train. A transducer and signal conditioner produces a horn output pulse train at a frequency equal to the acoustic output of the horn. The horn output pulse train is applied to one input of a phase comparator. The output of the sweep frequency oscillator is applied to the other input of the phase comparator. The phase comparator generates a stop signal for the sweep frequency oscillator when the input signals are in phase with each other which signifies that the horn is operating at its resonant frequency.

7 Claims, 2 Drawing Sheets

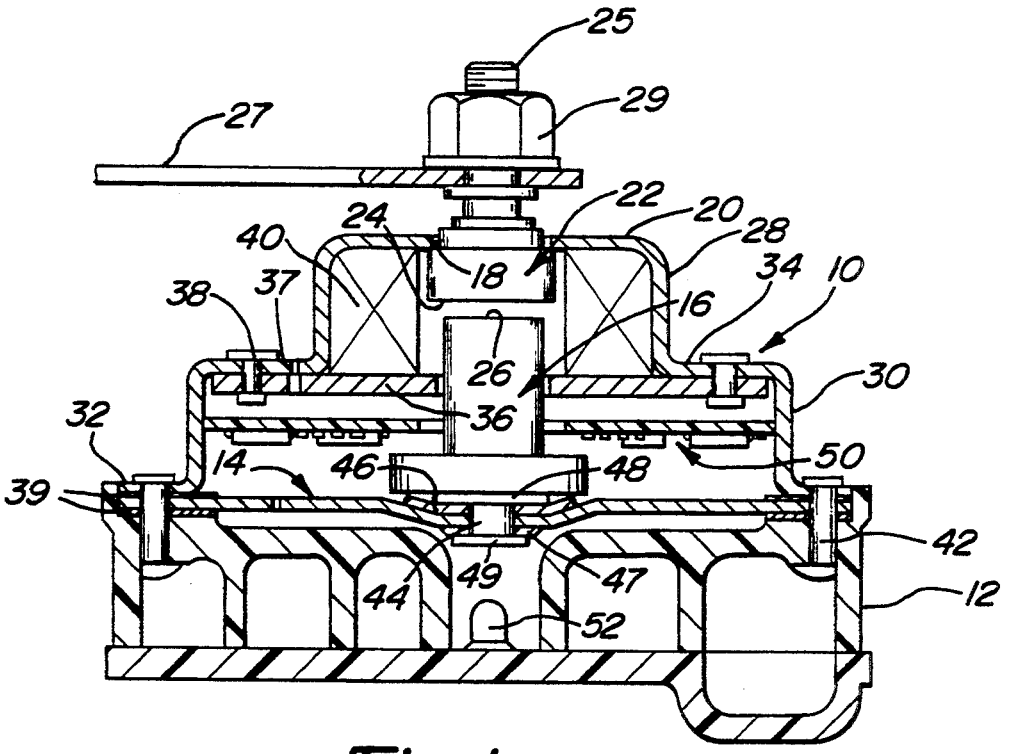
Fig-1
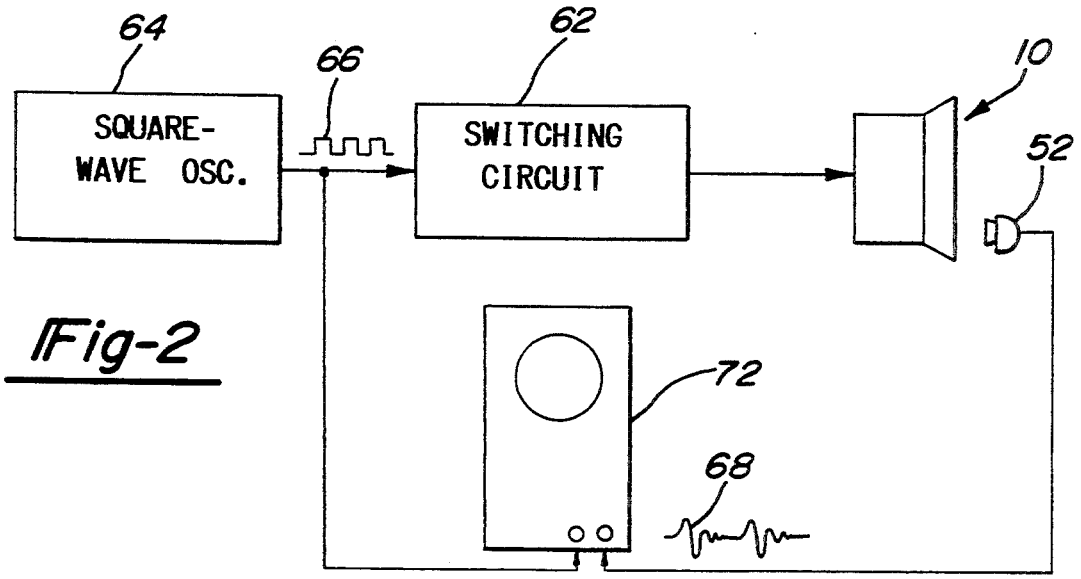
Fig-2
Fig-3a
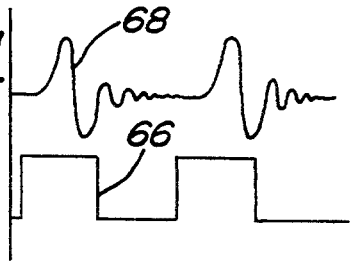
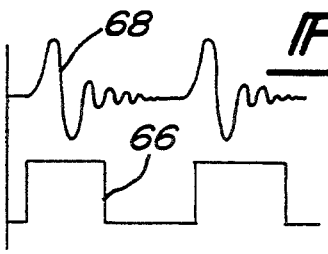
Fig-3b

SELF-TUNING VEHICLE HORN

FIELD OF THE INVENTION

This invention relates to vehicle horns; more particularly, it relates to a vehicle horn which is self-adjusting to maximize the sound output.

BACKGROUND OF THE INVENTION

For many years, the electric horns commonly used on automotive vehicles have been of the type which generate sound by vibration of a diaphragm driven by an electromagnet motor. The horn typically comprises a housing with the diaphragm peripherally clamped thereto forming a motor chamber. The coil of the electromagnet is mounted within the chamber and a magnetic pole piece on the housing extends axially of the coil. A magnetic plunger on the diaphragm extends toward the pole piece for imparting motion to the diaphragm in response to periodic energization of the coil. The diaphragm provides a resilient suspension of the plunger for reciprocating motion relative to the coil; it has a spring characteristic whereby the diaphragm and the mass carried by it have a resonant frequency of mechanical vibration. The coil is energized from the vehicle battery through a mechanically actuated switch which is alternately opened and closed by movement of the plunger with the diaphragm. A vehicle horn of this kind is described in the Wilson et al U.S. Pat. No. 4,813,123 granted Mar. 21, 1989.

Although vehicle horns of the type just described have been eminently successful in the automotive industry for many years, there have been certain problems which, for a long time, have seemingly defied solution. One such problem is that of manufacturing the horn with sufficiently exacting mechanical and electrical relationships so as to obtain a high degree of operating efficiency. Particularly, such horns have not been readily adjustable to obtain operation at the maximum achievable sound pressure level for a given input power.

A vehicle horn which employs a solid state driver circuit for the horn coil is disclosed and claimed in U.S. Pat. No. 5,049,853, issued Sep. 17, 1991 assigned to the assignee of this application. In that horn, the driver circuit is adapted to energize the horn coil to cause vibrations of the diaphragm at its resonant frequency. The solid state driver has an electronic timer adjustable to the frequency of the diaphragm assembly and switches a solid state power output stage to drive the diaphragm synchronously with the timer frequency.

Another vehicle horn which employs a solid state driver circuit is disclosed and claimed in copending application Ser. No. 684,693 filed Apr. 12, 1991 by Carl R. Wilson et al and assigned to the assignee of this application. The horn described in that patent application has an energizing circuit and electromagnet for driving a diaphragm assembly at its resonant frequency of mechanical vibration. The energizing circuit generates a DC pulse train for energizing the coil of the electromagnet to drive the diaphragm. The circuit has an adjustment for setting the pulse repetition rate of the pulse train substantially equal to the resonant frequency. This setting is made as a factory adjustment. The rated supply voltage is applied to the horn and the horn is operated over a frequency range sufficiently broad to include that frequency which produces a maximum sound pressure level output from the horn. The sound pressure level output is monitored to determine the frequency which produces the maximum output. The horn energizing circuit is adjusted to produce a pulse train at that frequency.

The vehicle horn of the type referred to above, is typically fitted with either a resonant projector or a resonator to propagate sound pressure waves into the atmosphere. The resonant projector is a trumpet-like device comprising a spiral passageway to define an air column of increasing cross-section from the inlet end at the diaphragm to the outlet end at a bell. A horn with this acoustic coupling device is commonly known as a "seashell" horn. It generates sound by the free vibration of the diaphragm. The resonator is a vibratory plate of circular configuration which is mounted at its center on the diaphragm and plunger. In this device, the horn is energized so that the plunger strikes the pole piece during each cycle of diaphragm motion; the force of the strike is transferred to the center of the circular resonator causing it to vibrate at its natural frequency and generate sound pressure waves which are propagated directly into the surrounding atmosphere without any intermediate coupling device. This type of horn is commonly known as a "vibrator" horn. The two horns produce distinctly different sounds. A vehicle is sometimes provided with a pair of seashell horns or a pair of vibrator horns. To produce the desired sound, one horn of each pair is designed for relatively low frequency and the other for high. For the vibrator horns this is typically 350 Hz and 440 Hz. For seashell horns it is 400 Hz and 500 Hz.

In such vehicle horns, it is desired to operate the horn so that the diaphragm is vibrated at its natural resonant frequency. This provides the maximum sound pressure level output from the horn for a given input power.

A general object of this invention is to provide a vehicle horn with a solid state energizing circuit which permits adjustment for operation with high efficiency at maximum sound pressure level and to overcome certain disadvantages of the prior art.

SUMMARY OF THE INVENTION

In accordance with this invention, a vehicle horn is provided with a circuit which determines the optimum frequency of energization of the horn. This is accomplished by adjusting the input pulse frequency to a value which produces a sound pressure wave from the horn having substantially zero phase displacement from the input pulse train.

Further, in accordance with this invention, a vehicle horn is provided with a self-adjusting energizing circuit which energizes the horn coil with an input pulse train which is adjusted in frequency to a value which produces an output sound pressure wave from the horn which is in-phase with the input pulse train.

Further, in accordance with this invention, a self-adjusting circuit of the horn is adapted to reset the pulse frequency energization of the horn in accordance with changing conditions and thereby maintain the energizing pulse frequency in correspondence with the resonant frequency of the horn.

A complete understanding of this invention may be obtained from the detailed description that follows taken with the accompanying drawings.

DESCRIPTION OF THE DRAWINGS

FIG. 1 is a cross-sectional view of an electric vehicle horn;

FIG. 2 is a block diagram of a test circuit for demonstrating the relationship between the horn input frequency of the horn switching pulse train and the phase relationship between the horn input and the horn output;

FIGS. 3*a* and 3*b* show the different phase relations between horn input and output for different frequencies;

BEST MODE FOR CARRYING OUT THE INVENTION

Figure 4:
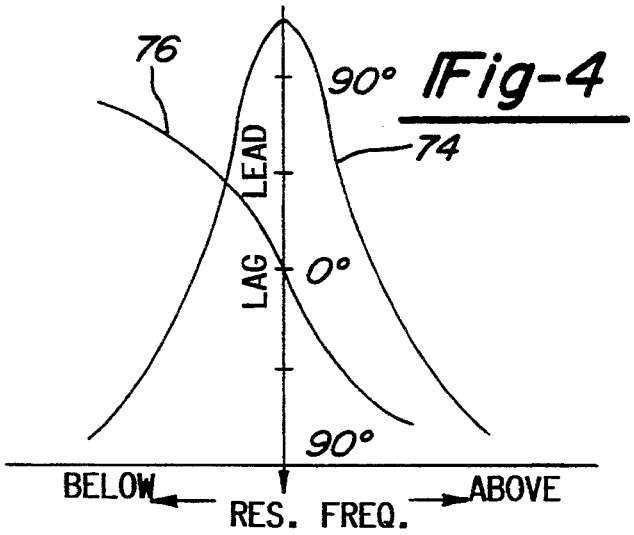
FIG. 4 is a graphical representation of the acoustic resonance of a typical vehicle horn and the phase shift between horn input and output with variation of input frequency.

Referring now to the drawings, there is shown an illustrative embodiment of the invention in a horn energizing circuit of an electric vehicle horn. The horn energizing circuit is self-adjusting to energize the horn at its resonant frequency. In the illustrative embodiment, a horn of the seashell type is energized with a horn input pulse train having a frequency which produces a horn output pulse train which is substantially in phase with the input pulse train. It will be appreciated as the description proceeds that the invention may be used in other types of horns and may be realized in different embodiments.

FIG. 1 shows a vehicle horn of the seashell type which incorporates the subject invention. It has a cup-shaped metal housing 10 secured to a plastic projector 12. A spring steel diaphragm 14 is clamped at its periphery between the housing 10 and projector 12 and is attached at its center to a ferromagnetic plunger 16. An aperture 18 in an end wall 20 of the housing 10 holds a pole piece 22 which extends toward the plunger 16. An end face 24 of the pole piece 22 is spaced from an end face 26 of the plunger 16 by an air gap. The opposite end 25 of the pole piece 22 is threaded to receive a mounting bracket 27 and a securing nut 29.

The housing 10 is stepped to define a small closed-end portion 28 including the end wall 20, and a larger open-end portion 30 terminating in a radial flange 32 for supporting the diaphragm. An intermediate generally planar annular portion 34 interconnects the small end portion 28 and the larger portion 30. An electromagnetic coil 40 fits within the small end portion 28 and surrounds adjacent ends of the plunger 16 and the pole piece 22. An annular mounting plate 36 secured to the intermediate portion 34 by rivets 38 retains the coil in the end portion 28. The plate 36 is apertured to accommodate the plunger 16 for free movement therein.

The diaphragm 14 is mounted on the flange 32 of the housing between annular gaskets 39 which conform to the diaphragm periphery. The projector presses the gaskets 39 and diaphragm 14 against the flange 32 and fasteners 42 secure the assembly. The plunger 16 has a stem 44 of small diameter protruding through the diaphragm at its center and through a washers 46 and 47 on opposite sides of the diaphragm. The stem defines a shoulder 48 on the plunger to engage washer 46 and it defines a head 49 at its free end which engages the other washer 47, there securing the diaphragm and the plunger for movement as a unit. The combined mass of the diaphragm 14 and the plunger 16 along with the spring rate of the diaphragm determine the resonant frequency of the diaphragm assembly which is the same as the resonant frequency of the horn.

The coil 40 is energized from the vehicle battery by the solid state energizing circuit of this invention which is provided on a circuit board 50. The energizing circuit of the horn includes a transducer in the form of a microphone 52 which is mounted at the input of the projector 12. The circuit board can be located either inside or outside the housing. In the illustrative embodiment, the circuit board is suitably mounted on the plate 36 inside the housing and is electrically connected by external horn terminals (not shown) to the vehicle battery and to the horn switch. The resultant sound is transmitted by the projector 12. The mechanical aspect of the horn is described in further detail in U.S. Pat. No. 4,361,952 issued to James Neese, which is incorporated herein by reference.

A vehicle horn, such as the seashell horn described above with reference to FIG. 1 and the vibrator-type horn referred to above, has a very high mechanical "Q" factor, i.e. the mechanical resonance curve has a very sharp peak at the resonant frequency. For example, a typical seashell horn may have a resonance curve with 3 dB points at about $\pm 1.5$ Hz with a resonant frequency at about 400 Hz. This corresponds to a Q of 133. When the horn coil is energized with an input pulse train over a frequency range which includes the mechanical resonant frequency of the horn, there is a definite phase relationship between the input pulse train to the horn coil and the output pulse train derived from the vibrational excursions of the horn diaphragm and the resultant sound pressure waves. It has been found that the phase displacement between the input and output pulse trains is substantially zero when the input pulse train has a frequency equal to the mechanical resonant frequency of the horn.

This relationship can be readily demonstrated by a test set-up as shown in FIG. 2. In this test set-up, the horn 10 is energized by an electronic switching circuit 62 which includes an electronic power switch connected in series with the coil of the horn 10. The circuit 62 is switched at an adjustable frequency by a square wave oscillator 64. The horn input signal is represented by the pulse train 66. The horn output pulse train, as produced by the vibrational excursions of the horn diaphragm, is sensed by the microphone 52. The microphone 52 produces a horn output signal waveform 68 which represents the output of the horn.

The phase relationship between the horn input signal 66 and the horn output signal 68 is displayed on an oscilloscope 72 for different frequencies of the input signal 66. For this purpose, the signal 66 of the oscillator is applied to input #1 of the oscilloscope 72 and the signal 68 is applied to input #2 of the oscilloscope. When the frequency of the oscillator 64 is above the mechanical resonance of the horn 10, the signal 68 lags the signal 66, as shown in FIG. 3*a*. When the frequency of the oscillator 64 is equal to the mechanical resonant frequency of the horn, the output signal 68 is in-phase with the input signal 66, as shown in FIG. 3*b*. In this relationship, the leading edge of the input signal coincides in time with the leading edge of the output signal. The coincidence of this in-phase relationship with the resonant frequency can be verified by using a dB meter and noting that maximum sound output of the horn occurs simultaneously with the in-phase relationship.

Figure 5:
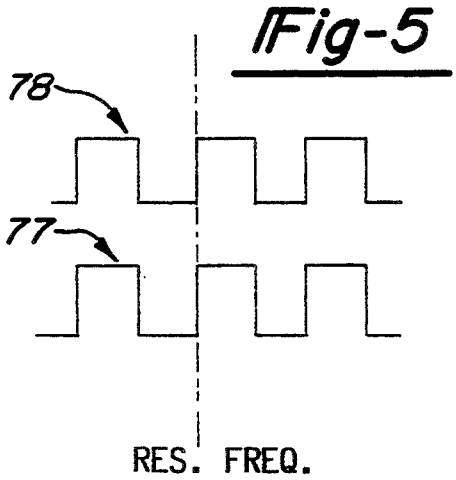
FIG. 5 shows the phase relation of horn input and output for explanatory purposes.

The acoustic resonance as a function of frequency for a typical horn, such as horn 10, is shown graphically in FIG. 4 in relation to the phase angle between the horn input signal and the horn output signal. The acoustic resonance curve 74 shows the variation of horn output, i.e. sound pressure level, as a function of frequency in the vicinity of the resonant frequency of the horn. It is noted that the resonance curve reaches a maximum at the resonant frequency of the horn. FIG. 4 also shows a phase angle curve 76 which represents the phase difference between the horn input signal and the horn output signal in the vicinity of the resonant frequency of the horn. When the horn input signal has a frequency below the resonant frequency of the horn, the horn output signal leads the horn input signal; conversely when the horn input signal is above the resonant frequency of the horn, the horn output signal lags the horn input signal. When the horn input frequency is equal to the resonant frequency of the horn, the horn input signal 77 and the horn output signal 78 (both shown as square waves) are in phase with each other as depicted in FIG. 5.

Figure 6:
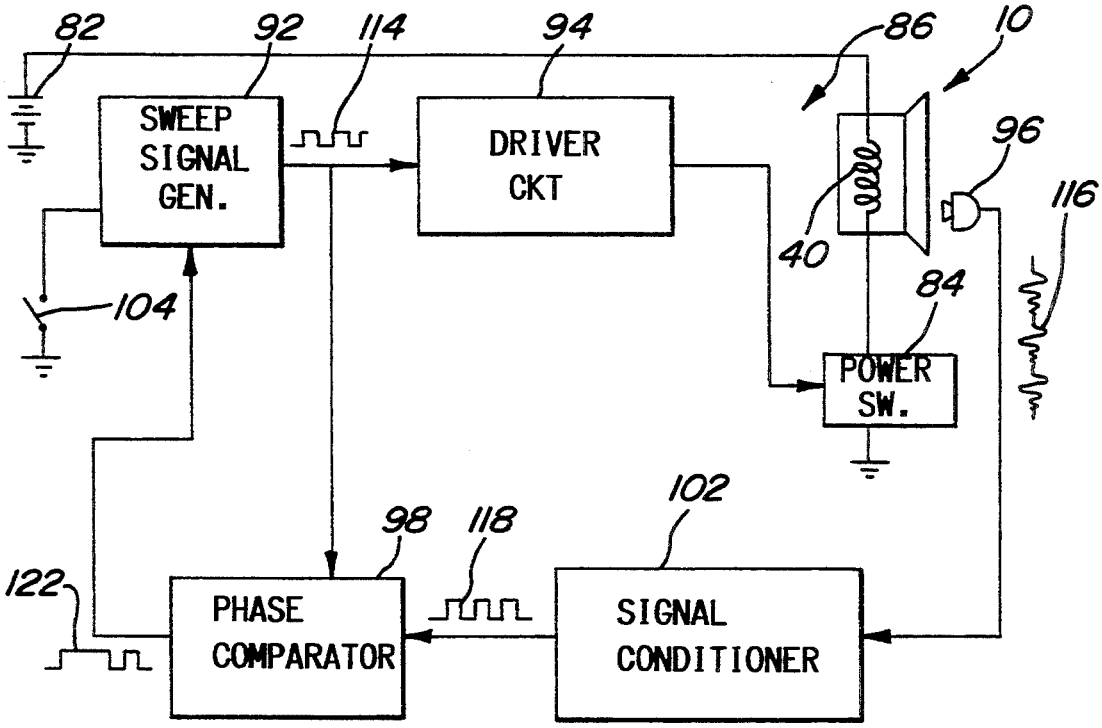
FIG. 6 is a block diagram of a self-tuning horn according to this invention.

Referring now to FIG. 6, the invention will be described as it is embodied in a horn 10 of the seashell type described above. The horn coil 40 is energized from the vehicle battery 82 through an electronic power switch 84 such as a power MOSFET. A control circuit 86 is provided for controlling the switching of the power switch 84 at substantially the same frequency, say within ±20 Hz., of the resonant frequency of the horn.

The control circuit 86 comprises, in general, a variable frequency pulse generator, a transducer circuit and a phase comparison circuit. The pulse generator includes a sweep signal generator 92 and a driver circuit 94 which control the switching frequency of the power switch 84. The transducer circuit includes a transducer 96 and a signal conditioner 102 which produces a horn output signal which is applied as one input to a phase comparator 98. The output of the sweep signal generator 92 is applied to the other input of the phase comparator 98 which produces a start/stop signal for the sweep signal generator. A horn switch 104, for the vehicle driver, controls the on/off energization of the horn 10.

Figure 7:
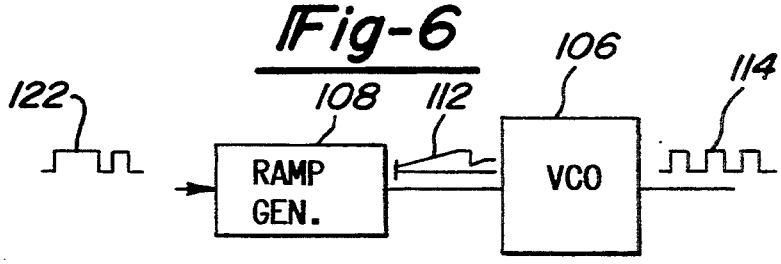
FIG. 7 is a block diagram of the sweep signal generator of FIG. 6.

The sweep signal generator 92 is shown in more detail in FIG. 7. It comprises a voltage controlled oscillator 106 (VCO) and a ramp generator 108. Oscillator 106 produces an output signal voltage with a frequency which is variable in accordance with the value of the signal voltage applied to its input. The frequency range of the oscillator 106 is broad enough to include the resonant frequency of the horn and may be approximately centered around a typical resonant frequency, say 400 cycles. The ramp generator 108 produces, at its output, a ramp voltage waveform having a preset slope; the generation of the ramp output voltage is initiated from a reference voltage level in response to the input of a start signal, i.e. a logic high signal voltage, at its input. The ramp voltage is held or stored at the value attained at the occurrence of a stop signal, i.e. a logic low signal voltage, at its input. Thus, the frequency of the VCO is swept from a low frequency corresponding to the reference voltage level of the ramp voltage to a higher frequency corresponding to the voltage level attained at the occurrence of the stop signal.

The transducer 96 for producing an output signal voltage corresponding to the horn output is suitably an acoustic microphone which responds to the sound pressure waves generated by vibration of the horn diaphragm. However, other transducers may be used for producing an electric signal having a frequency equal to the sound output frequency of the horn. For example, a ceramic piezoelectric plate may be adhesively mounted on the diaphragm. Alternatively, an accelerometer may be mounted on the horn housing for sensing the vibrational frequency of the horn.

Operation of the circuit of FIG. 6 will now be described. When the horn switch 104 is closed, the sweep signal generator 92 is turned on and the control circuit 86 assumes control of the frequency of the input switching signal to the power switch 84. The sweep signal generator 92 produces an output square wave pulse signal 114 which, at start-up, has a pulse repetition rate or frequency determined by the reference voltage level input of the ramp generator 108 and it is below the resonant frequency of the horn. As the ramp voltage 112 increases, the frequency of the output signal 114 increases and the switching frequency of the horn coil 40 by power switch 84 increases concurrently. The horn output signal generated by the pulse energization of the coil 40 is sensed by the transducer 96. The transducer 96 produces an output signal voltage 116 having a frequency corresponding to the sound waves generated by the horn 10. This transducer signal 116 is applied to the input of the signal conditioner 102 which produces an output square wave signal 118 having the same fundamental frequency as that of the transducer signal 116. The output signal 118 of the signal conditioner, which represents the frequency and phase of the horn output signal, is applied to one input of the phase comparator 98. The output signal 114 of the sweep signal generator 92, which represents the frequency and phase of the horn input signal is applied to the other input of the phase comparator 98. The phase comparator produces a start/stop output signal 122 which is applied to the input of the ramp generator 108 of the signal generator 92. The output signal 122 of the phase comparator 98 has a logic high value when there is a phase difference between the horn output signal, as represented by signal 118, and the horn input signal, as represented by signal 114. When the signals 118 and 114 are in-phase with each other, i.e. the leading edges are coincident in time, the output signal 122 of the phase comparator is at logic low. A logic high voltage at the input of the ramp generator 108 of the sweep signal generator is a start signal for the ramp output voltage 112. A logic low voltage input to the ramp generator 108 is a stop signal which inhibits further increase in the ramp output voltage 112 and the output signal 114 of the sweep signal generator 92 is thereby maintained at a frequency equal to the resonant frequency of the horn 10. This is the optimum operating frequency for the horn to obtain maximum sound pressure output from a given input power to the horn.

If operating conditions of the horn, such as temperature, change its resonant frequency, the control circuit 86 will automatically reset the horn input frequency to regain operation at resonant frequency. If the horn resonant frequency changes to a higher frequency or to a lower frequency, the phase comparator 98 will detect a phase difference between the horn input signal and the horn output signal. In response to the phase difference, the phase comparator 98 will produce a logic high output voltage which is applied to the input of the ramp generator 108. This voltage change resets the ramp output signal 112 to its reference value and reinitiates generation of the ramp signal. When the sweep signal generator output signal 114 reaches a frequency which produces phase coincidence of the horn input and horn output signals, the phase comparator 98 will generate a stop signal as described above to hold the horn input signal at the resonant frequency of the horn.

Although the description of this invention has been given with reference to a particular embodiment, it is not to be construed in the limiting sense. Many variations and modifications will now occur to those skilled in the art. For a definition of the invention reference is made to the appended claims.

What is claimed is:

1. In a horn for an automotive vehicle, said horn being of the type comprising a housing having a diaphragm and a magnetic pole piece mounted thereon, a coil for magnetizing the pole piece, a magnetic plunger mounted on the diaphragm in magnetic circuit with the pole piece, said diaphragm and the mass carried thereby having a resonant frequency of mechanical vibration, an electronic power switch connected in series with said coil, and a control circuit for applying a horn input signal to the input of said switch for turning it off and on, the improvement wherein said control circuit comprises:

a variable frequency pulse generator having an output coupled with the input of said switch and generating a variable frequency horn input signal having a frequency range including said resonant frequency, a transducer circuit responsive to the vibration of said diaphragm for producing a horn output signal having a frequency corresponding to the actual frequency of said mechanical vibration, and phase comparison means responsive to said horn input signal and said horn output signal for inhibiting change of frequency of the pulse generator when the phase difference between said horn input and horn output signals is substantially zero.

2. The invention as defined in claim 1 wherein said variable frequency pulse generator comprises a sweep frequency oscillator for generating a square wave oscillator output signal and a driver circuit having its input connected with said oscillator for producing said switching signal.

3. The invention as defined in claim 1 wherein said transducer circuit comprises a microphone responsive to the acoustic output of said horn and a signal conditioning circuit coupled between said microphone and said phase comparison means.

4. The invention as defined in claim 2 wherein said sweep frequency oscillator comprises a voltage controlled oscillator and a ramp generator coupled to the input of said voltage controlled oscillator.

5. The invention as defined in claim 1 wherein said phase comparison means comprises a phase comparator having an input connected with the output of said transducer circuit and another input connected with the output of said pulse generator and having an output coupled with the input of said pulse generator.

6. The invention as defined in claim 4 wherein said ramp generator is reset to its reference voltage in response to a start signal from said phase comparison means.

7. The method of operating a horn for an automotive vehicle, said horn being of the type comprising a housing having a diaphragm and a magnetic pole piece mounted thereon, a driving coil for magnetizing the pole piece, a magnetic plunger mounted on a diaphragm in magnetic circuit with the pole piece, said diaphragm and the mass carried thereby having a resonant frequency of mechanical vibration, an electronic power switch connected in series with a voltage source and said driving coil, and a variable frequency switching circuit for generating a variable frequency pulse train coupled with the input of said switch for turning it off and on, said method comprising the following steps:

varying the frequency of said switching circuit over a range including said resonant frequency, and inhibiting frequency change of said switching circuit when the phase difference between horn output sound pulses and the pulse train is determined to be substantially zero.

* * * * *